US005643018A

United States Patent [19]

Sakai et al.

[11] Patent Number: 5,643,018

[45] Date of Patent: Jul. 1, 1997

[54] TERMINAL FOR WATERPROOF CONNECTORS

[75] Inventors: Hitoshi Sakai; Naoto Sugie, both of Haibara-gun, Japan

[73] Assignee: Yazaki Corporation, Tokyo, Japan

[21] Appl. No.: 424,101

[22] Filed: Apr. 19, 1995

[30] Foreign Application Priority Data

Apr. 20, 1994 [JP] Japan ..... 6-081400
Dec. 2, 1994 [JP] Japan ..... 6-299608

[51] Int. Cl.[6] ..... H01R 13/11

[52] U.S. Cl. ..... 439/852; 439/595

[58] Field of Search ..... 439/595, 861, 439/852, 587, 589, 851

[56] References Cited

U.S. PATENT DOCUMENTS

| | | | |
|---|---|---|---|
| 2,825,883 | 3/1958 | Batcheller | 439/851 |
| 3,609,640 | 9/1971 | Longenecker et al. | 439/852 X |
| 4,909,762 | 3/1990 | Yagi et al. | 439/852 |
| 5,271,741 | 12/1993 | Saito et al. | 439/851 X |
| 5,288,252 | 2/1994 | Steinhardt et al. | 439/851 X |
| 5,308,267 | 5/1994 | Hotea | 439/851 |
| 5,443,592 | 8/1995 | Ittah et al. | 439/851 |

FOREIGN PATENT DOCUMENTS 64-16074 1/1989 Japan .

*Primary Examiner*—Allan N. Shoap
*Assistant Examiner*—Christopher J. McDonald
*Attorney, Agent, or Firm*—Armstrong, Westerman, Hattori, McLeland & Naughton

[57] ABSTRACT

A terminal for waterproof connectors is provided which includes a receptor portion. The receptor portion comprises a bottom plate and lateral walls provided upright on opposite sides of the bottom plate. A slanting insertion guide surface extends from an intermediate height of a front end of each lateral wall to a retreated front end of the bottom plate so as to provide a cutaway portion therebelow. The terminal for waterproof connectors does not give damages to an insertion hole in a waterproof stopper when passed therethrough.

6 Claims, 9 Drawing Sheets

FIG. 15A
PRIOR ART
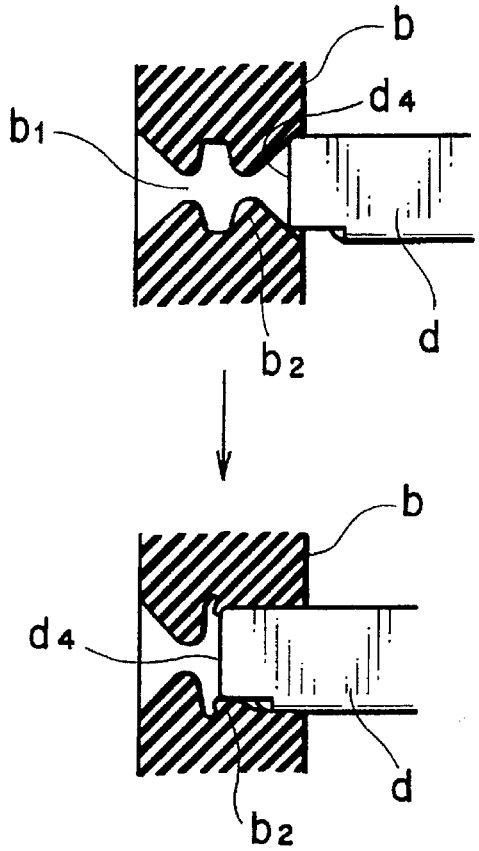
FIG. 15B
PRIOR ART
FIG. 16
PRIOR ART
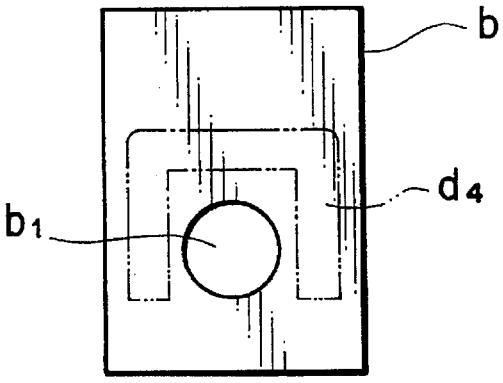

TERMINAL FOR WATERPROOF CONNECTORS

BACKGROUND OF THE INVENTION

1. Field of the Invention

This invention relates to a terminal for use with waterproof connectors, mainly used for connection of wiring harnesses.

2. Description of the Related

FIGS. 12 to 16 show a conventional terminal for waterproof connectors.

In FIG. 12, a represents a waterproof connector, b a mat-like waterproof stopper, c a hold-down cover for the waterproof stopper and d a terminal. The waterproof stopper b is, in advance, fitted in an open chamber e at the rear end of the connector a and held in place by the hold-down cover c.

The terminal d with a wire f connected in advance pushed through a through-hole c1 in the hold-down cover and an insertion hole b1 in the waterproof stopper b into a terminal accommodating chamber a1 in connector a in which the terminal d is locked by means of a resilient locking piece a2 shown in FIG. 14.

As enlargedly shown in FIG. 13, the terminal d includes a female receptor portion d1 for receiving a mating male terminal, the receptor portion d1 being at the front lower end and formed with a cutaway portion d2. A folded-back resilient contact plate d3 is continuous via a curved bent portion d3' to the front end of the receptor portion-constituting bottom plate, the bent portion d3' being located at an intermediate length of the cutaway portion d2. Thus, the cutaway portion d2, which is provided for the resilient contact plate d3, causes an edge portion d6 to be formed at the front loner end of each lateral wall d5 of the receptor portion d1.

FIG. 14 shows an initial stage of insertion of the terminal d into the waterproof connector a. A large U-shaped square front end face d4 of the terminal d comes into contact with a waterproof rib b2 in the insertion hole (FIG. 15A) to immediately push the waterproof rib b2 aside and pass therethrough (FIG. 15B). As illustrated in FIG. 16, the initial area of contact of the U-shaped end face d4 against the waterproof rib b2 is large, resulting in the insertion hole b1 being widened abruptly while the edge portions d6 of the terminal d damage the waterproof rib b2, thereby resulting in the sealing performance being lowered.

This invention has been accomplished to overcome the above drawbacks and its object is to provide a terminal for waterproof connectors which has no such undesirable edge portions, in which the receptor portion of a terminal has a reduced initial area of contact on passing through the insertion hole of a waterproof stopper so as to avoid contact of edge portions of the receptor portion with an insertion hole-defining portion of the stopper, or in which the receptor portion of the terminal gradually widens the insertion hole in the stopper to prevent damage to the sealing surface thereof.

In order to attain the object, according to an aspect of this invention, there is provided a terminal for waterproof connectors including a receptor portion, the receptor portion comprising: a bottom plate; lateral walls provided upright at opposite sides of the bottom plate; and a slanting insertion guide surface extending from an intermediate height of a front end of each of the lateral walls to a retreated front end of the bottom plate so as to provide a cutaway portion therebelow.

The slanting insertion guide surface gradually widens the insertion hole in a waterproof stopper.

According to another aspect of this invention, there is provided a terminal for waterproof connectors including a receptor portion, the receptor portion comprising: a bottom plate; lateral walls provided upright at opposite sides of the bottom plate; and a slantingly inwardly bent portion adjacent to a front lower edge of each of the lateral walls, by means of which the front lower edge is displaced inwardly of a contour of the receptor portion.

According to a still another aspect of this invention, there is provided a terminal for waterproof connectors including a receptor portion, the receptor portion comprising: a bottom plate; lateral walls provided upright at opposite sides of the bottom plate; and an extension extending from a front lower end of each of the lateral walls, which is bent inwardly so as to be positioned inside a contour of the receptor portion.

The above and other objects, features and advantages of this invention will become apparent from the following description and the appended claims taken in conjunction with the accompanying drawings in which like parts or elements are denoted by like reference characters.

BRIEF DESCRIPTION OF THE DRAWINGS

FIGS. 15A and 15B are partial sectional views showing the process of inserting the receptor portion of the terminal of FIG. 14 into the waterproof stopper; and FIG. 16 is an explanatory view showing a comparison between the sizes of the waterproof stopper and the conventional terminal for waterproof connectors.

DESCRIPTION OF THE PREFERRED EMBODIMENT

Figure 1:
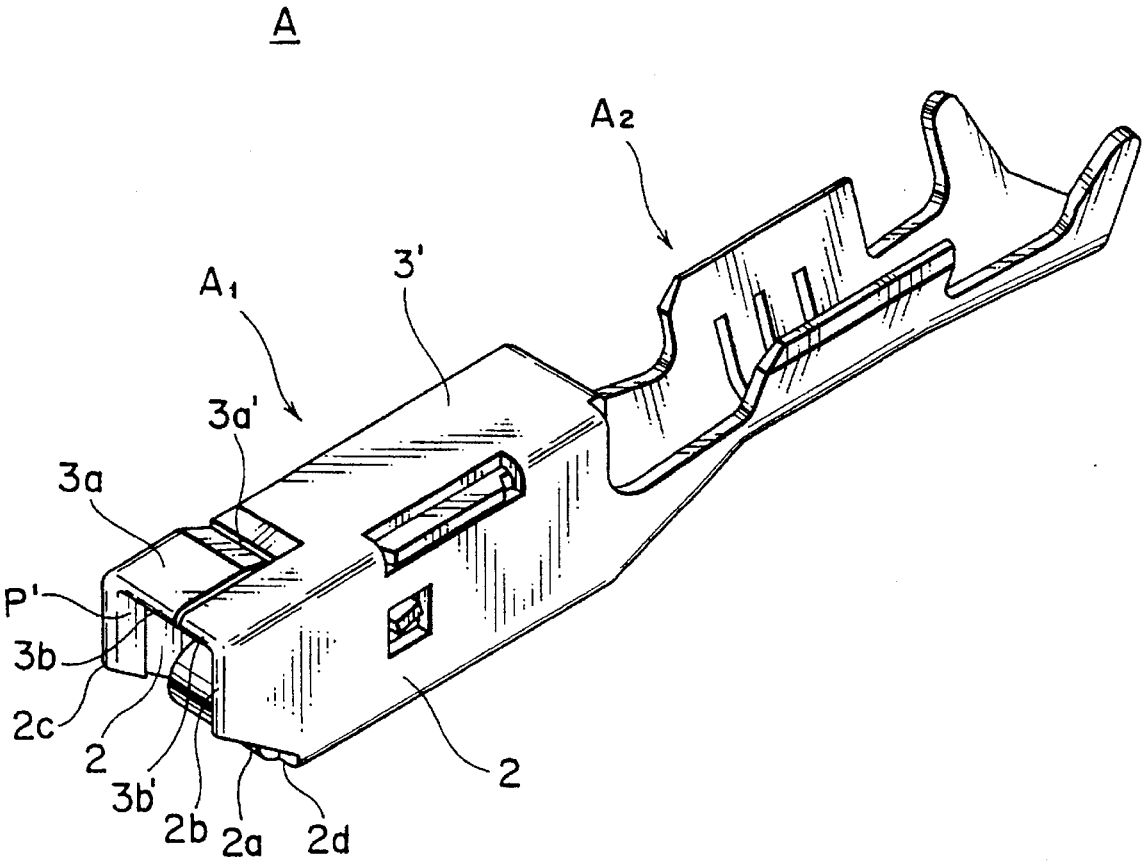
FIG. 1 is a perspective view of a terminal for waterproof connectors according to one embodiment of this invention.

FIG. 1 shows a terminal A for waterproof connectors according to one embodiment of this invention which includes a female case-like receptor portion A1 for receiving a mating male terminal (not shown) and a wire connection portion A2 integrally adjoining each other.

Figure 2:
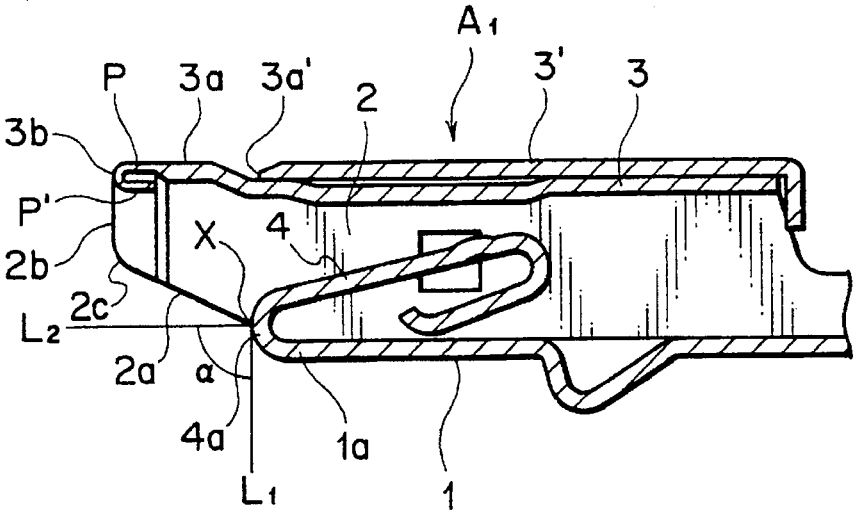
FIG. 2 is a partial enlarged sectional view of FIG. 1.

The receptor portion A1 comprises a bottom plate 1 and lateral walls 2, 2 provided upright at opposite sides of the bottom plate. Both lateral walls 2, 2 are at certain heights bent inwardly so as to form a double wall of plates 3 and 3' (FIG. 2). Inside a notch 3*a*' at the front end of the outer top plate 3' is located a portion 3*a* of the inner top plate 3 in a levelled manner with the outer top plate.

Each of the lateral walls 2, 2 has a slanting insertion guide surface 2*a* directed downwardly and extending from an intermediate height of its front end to a retreated front end of the bottom plate 1, which is formed by the cutting of the lateral wall. A curved bent portion 4*a*, via which a folded-back resilient contact plate 4 is continuously provided to the front end la of the bottom plate 1, (is protruded downwardly of a level of internal ends of the slanting insertion guide surfaces 2*a*.) Further, the curved bent portion 4*a* is located forwardly of a step-forming end 2*d* at the lower ends of the lateral walls 2. At the intersection X of the slanting insertion guide surface 2*a* with the curved bent portion 4*a* (FIG. 2), the angle α between the line L1 tangent to the curved bent portion 4*a* and the insertion direction line L2 is set 90 degrees or more. The slanting insertion guide surface 2*a* may be arcuate instead of straight, as illustrated in the drawing.

The front ends of both lateral walls 2, 2 and of the top plates 3, 3' are, in the process of manufacture, subjected to rolling into a thin plate which is folded back inwardly to provide a double plate portion of plates P and P', thereby providing non-edged front ends 2*b*, 3*b*, 3*b*'. A forwardly-facing curved guide surface 2*c* is further formed so as to extend from the front end surface 2*b* to the slanting insertion guide surface 2*a* of each lateral wall 2.

Figure 3:
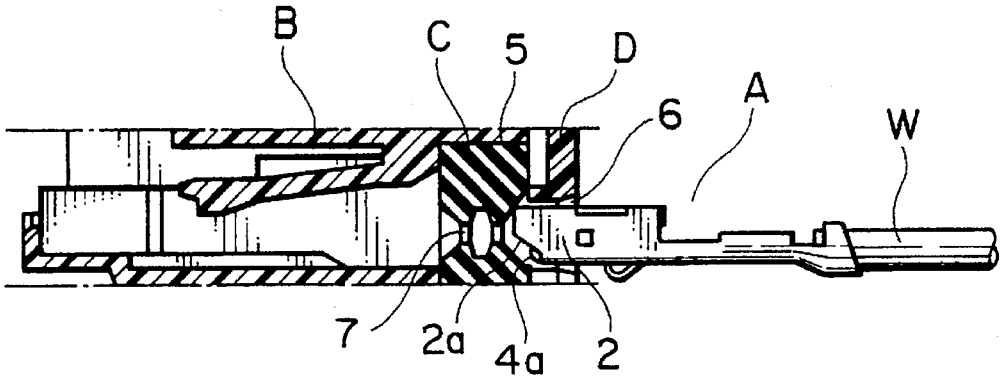
FIG. 3 is a sectional view showing the initial stage of the insertion of the above terminal into a waterproof connector housing.
Figure 4A:
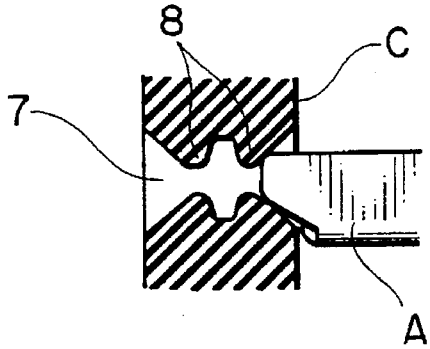
FIGS. 4A and 4B are partial sectional views of the terminal in the process of insertion into a waterproof stopper.
Figure 4B:
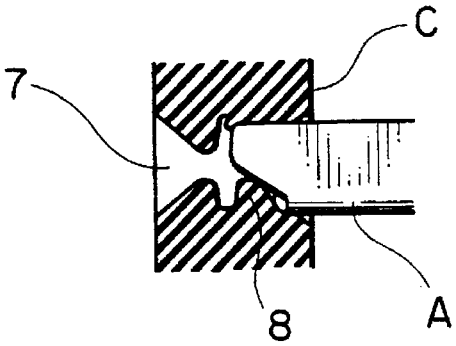
Figure 5:
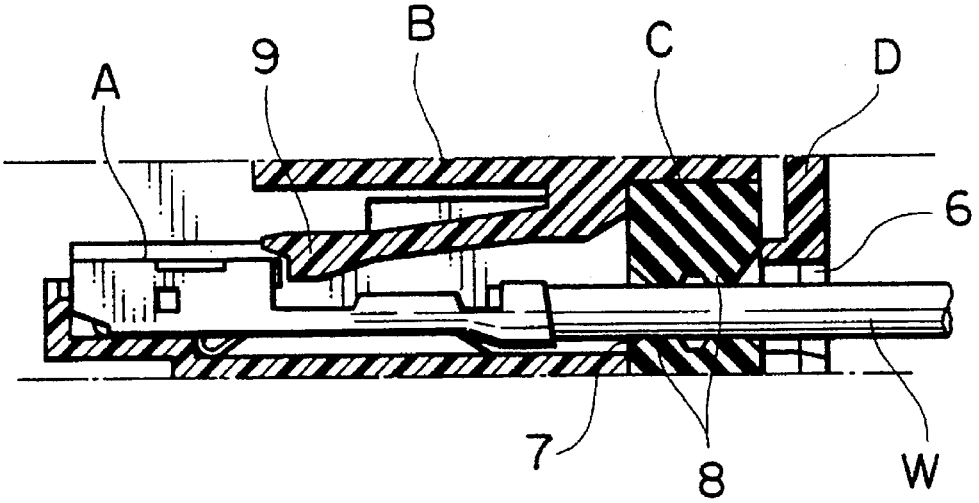
FIG. 5 is a sectional view showing the stage in which the insertion of the terminal into the waterproof connector housing has been completed.
Figure 6:
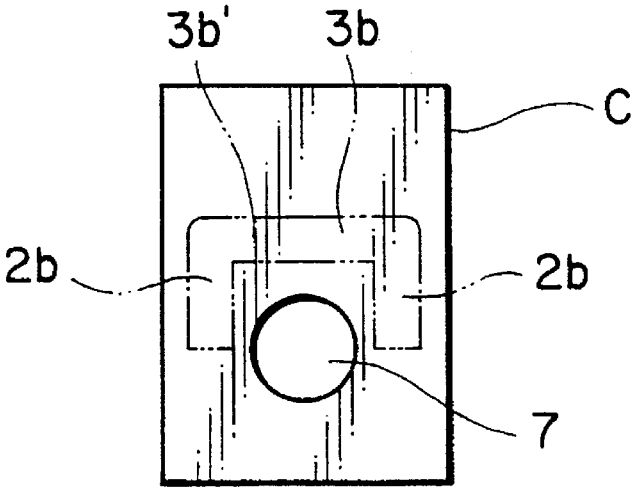
FIG. 6 is an explanatory view showing a comparison between the sizes of the waterproof stopper and the terminal for waterproof connectors.

In a chamber 5 at the rear end of a connector housing B is fitted a mat-like waterproof stopper C, which is held in place by a hold-down cover D. If, in this condition, a terminal A with a wire W connected in advance is pushed through the through-hole 6 and the insertion hole 7 (FIG. 3), the U-shaped non-edged front ends 2*b*, 3*b*, 3*b*' of small area abut against the waterproof rib 8 in the insertion hole 7 (FIG. 4A), to gradually push the rib 8 aside (FIG. 4B), so that the terminal is passed through the insertion hole 7 to be locked in a predetermined position by a resilient locking piece 9 (FIG. 5). Since the front ends 2*b*, 3*b*, 3*b*' of the terminal A are of small area and non-edged, as shown in FIG. 6, the insertion can be done with ease. Since the curved guide surfaces 2*c* and the subsequent slanting insertion guide surfaces 2*a* gradually widen the insertion hole 7, no damage is caused to the waterproof rib 8.

Figure 7:
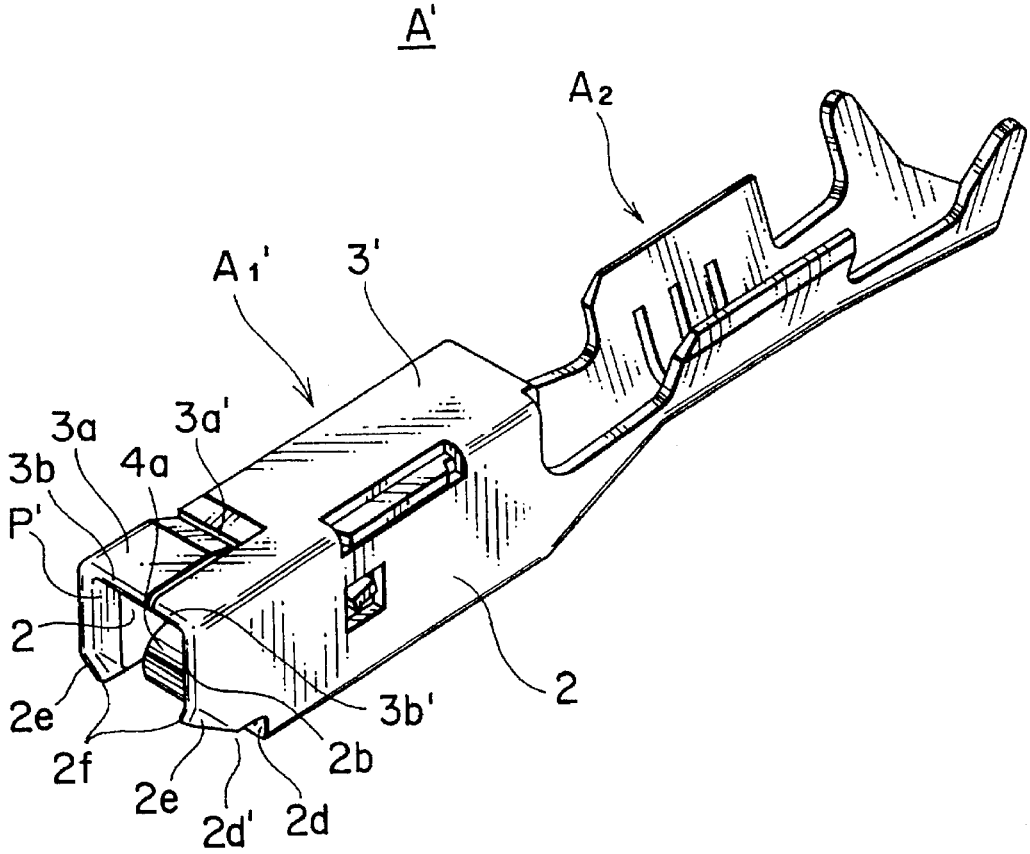
FIG. 7 is a perspective view of a terminal for waterproof connectors according to another embodiment of this invention.
Figure 8:
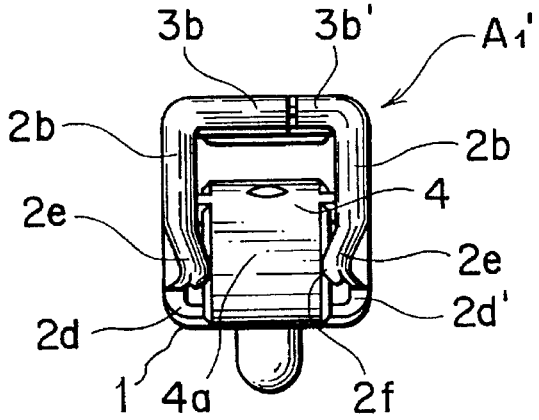
FIG. 8 is a front view of FIG. 7.

FIGS. 7 and 8 show a terminal A' for waterproof connectors according to another embodiment of this invention. The receptor portion A1' and wire connection portion A2 of the terminal each has the same basic structure as in FIG. 1 and like parts are denoted by like characters.

As shown in FIG. 7, a bent portion 2*e* is provided at the lower end of the double-plate front end 2*b* of each of the lateral walls 2, 2 of the receptor portion A1', the bent portion 2*e* being slantingly inwardly bent to cause an edge portion 2*f* to be located inside the contour of the receptor portion A1'. Each bent portion 2*e* extends slantingly from a first intermediate height of the front end 2*b* of each lateral wall 2 to a lower height disposed above the front end of the bottom plate 1 so as to provide a cutaway portion 2*d*' extending to the retreated front end 2*d* of the bottom plate. This reduces the initial area of contact of the receptor portion A1' against the waterproof stopper while, at the same time, avoiding contact between the edge portion 2*f* and the sealing surface of the waterproof stopper.

The slantingly inwardly bent portion 2*e* is thus located forwardly of the curved bent portion 4*a* at the foot of the resilient contact plate 4, so that the insertion of a mating male terminal into the receptor portion A1' is not hindered (FIG. 8).

Figure 9:
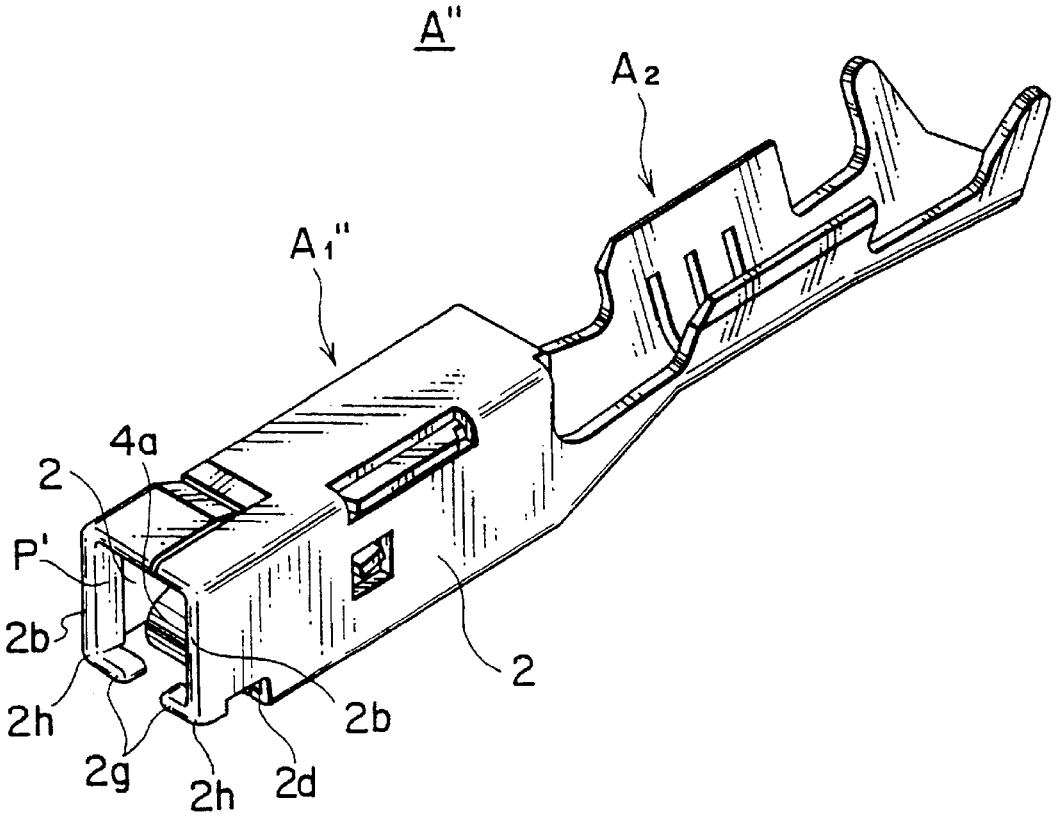
FIG. 9 is a perspective view of a terminal for waterproof connectors according to a still another embodiment of this invention.
Figure 10:
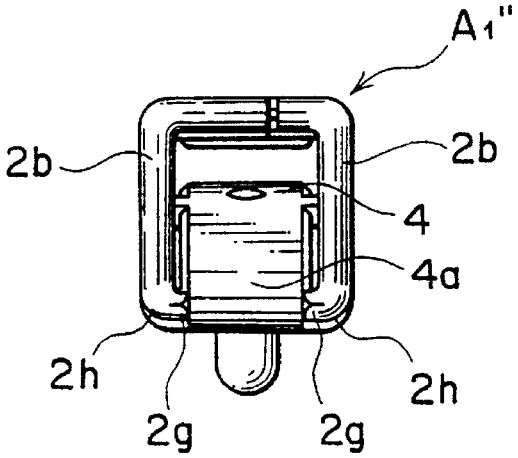
FIG. 10 is a front view of FIG. 9.

FIGS. 9 and 10 show a terminal A1" for waterproof connectors according to a still another embodiment of this invention, which includes a receptor portion A1" and a wire connection portion A2, each having the same basic structure as in FIG. 1.

Figure 11:
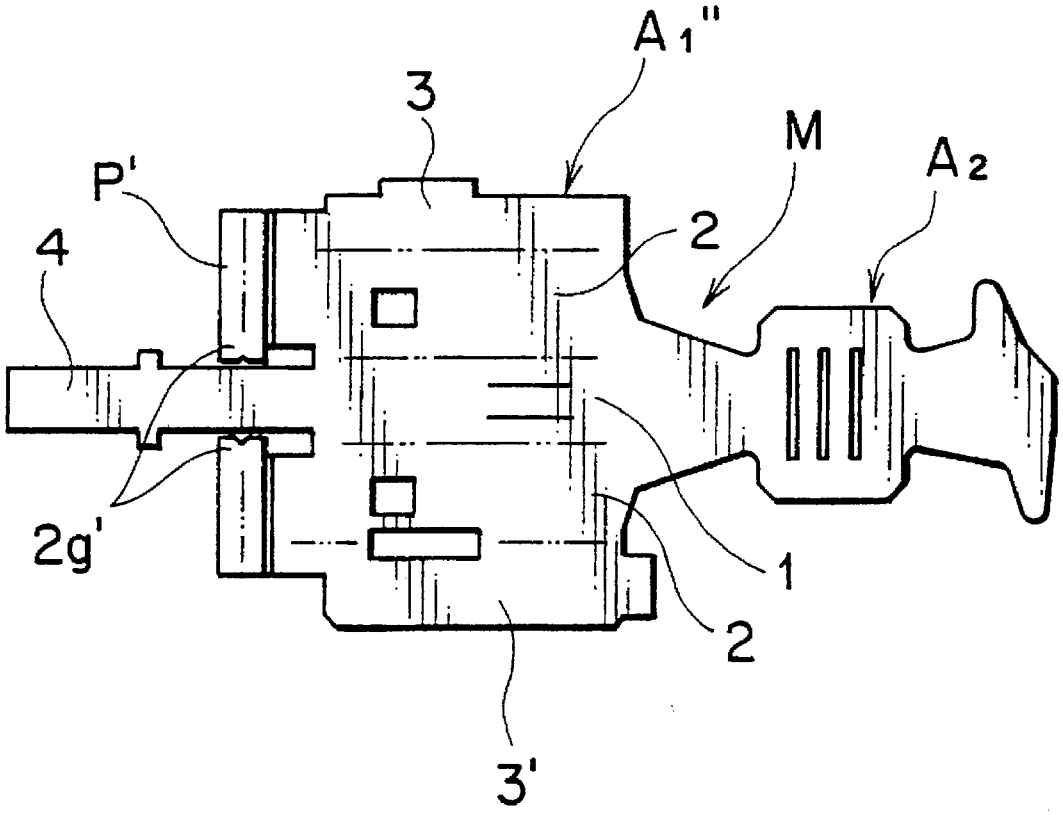
FIG. 11 is a developed view of a punched material for the above terminal.
Figure 12:
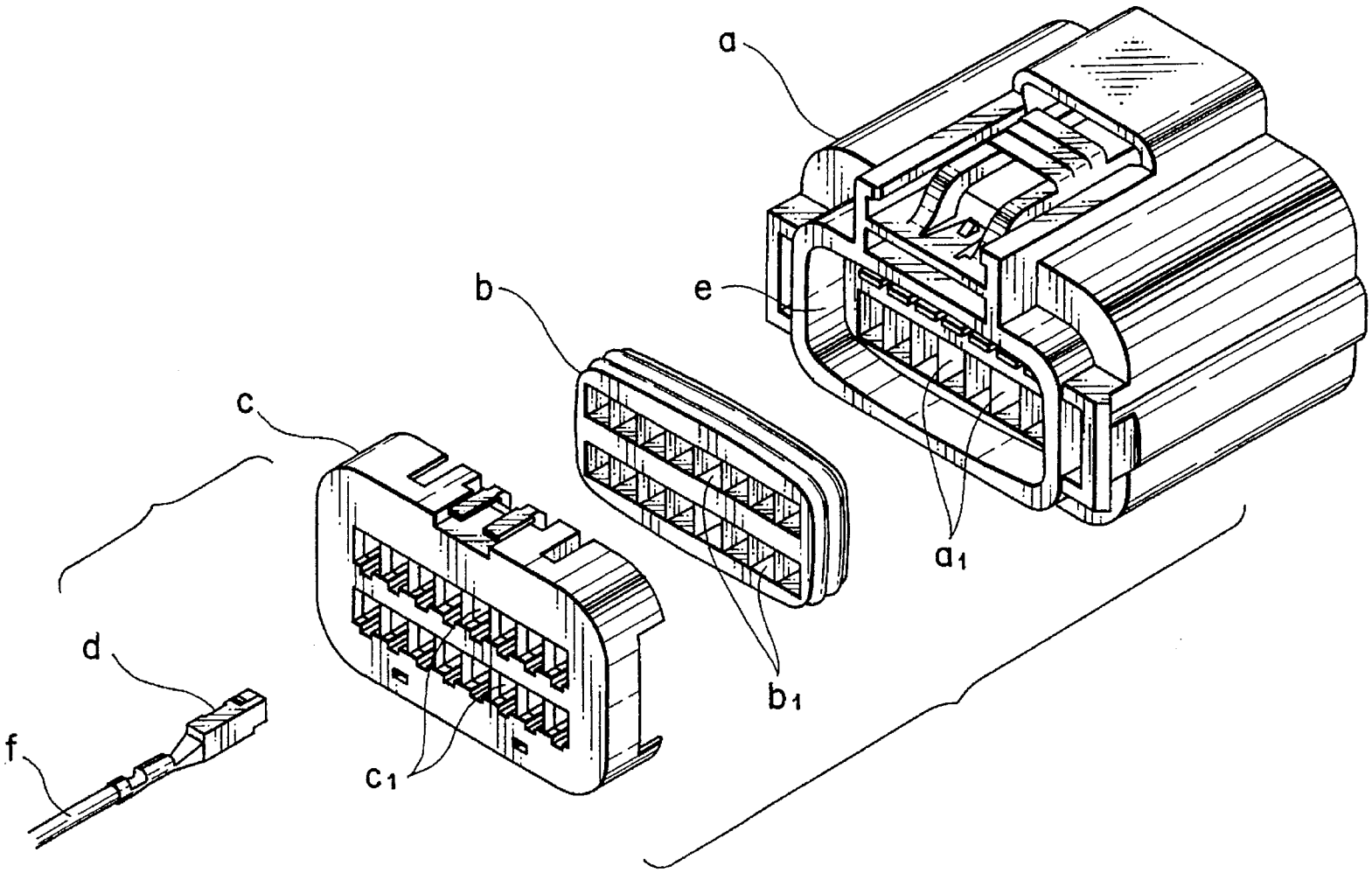
FIG. 12 PRIOR ART
FIG. 12 is an exploded perspective view of a conventional waterproof connector.
Figure 13:
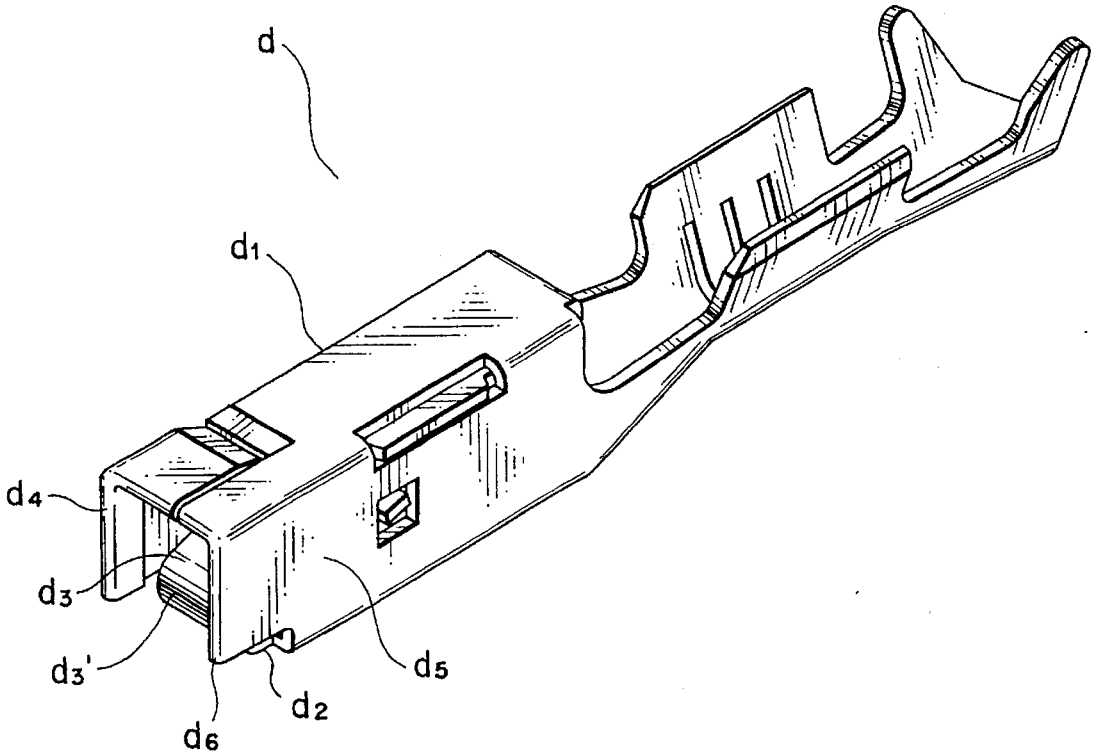
FIG. 13 PRIOR ART
FIG. 13 is a perspective view of a terminal for use with the waterproof connector in FIG. 12.
Figure 14:
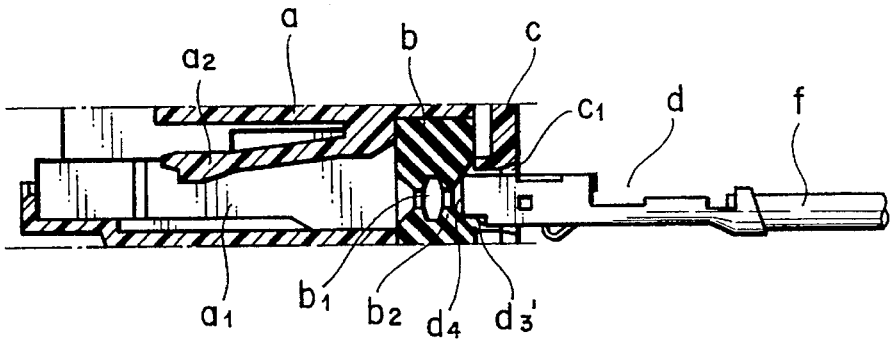
FIG. 14 PRIOR ART
FIG. 14 is a sectional view showing an initial stage of insertion of the above terminal into the waterproof connector.

As shown in FIG. 9, a double-plate extension 2*g* extends from the lower end of the double-plate front end 2*b* of each of the lateral walls 2, 2 of the receptor portion A1", which extension is inwardly bent at right angles with a curved portion 2*h* formed at the lower end of the double-plate front end 2*b* (FIG. 10). The extension 2*g* corresponds to an extension 2*g*' provided integrally in the punched metal sheet material M shown developed in FIG. 11. This eliminates an edge such as that indicated as 2*f* in the preceding embodiment (FIG. 10).

The inwardly bent portion 2*g*, as is the case with the previously described slantingly bent portion 2*e*, is located forwardly of the curved bent portion 4*a* at the foot of the resilient contact plate 4 and does not hinder the insertion of a mating male terminal into the receptor portion A1" (FIG. 10).

With the construction as described above, for the following reasons, no damage is unparted to the insertion hole in a waterproof stopper, thereby preventing a lowering in the seating performance. Edge portions at the front end of a receptor portion are eliminated, such edge portions being displaced into the inside of the receptor portion, or the front end surface of the receptor has a relatively small area and the slanting insertion guide surface adjoining the front end surface gradually widens the insertion hole in the waterproof stopper.

Since the curved bent portion of the folded-back resilient contact plate is positioned so as to protrude downwardly of the level of the inner ends of the slanting insertion guide surfaces, the step-forming lowermost end of each lateral wall is prevented from directly contacting the insertion hole-defining wall to damage the waterproof stopper.

Further, since the angle between the line tangent to the curved bent portion and an insertion direction line is set 90 degrees or more, the insertion of the curved bent portion into the insertion hole which protrudes from the slanting insertion guide surfaces is facilitaed.

Having now fully described the invention, it will be apparent to one of ordinary skill in the art that many changes and modifications can be made thereto without departing from the spirit and scope of the invention as set forth herein.

What is claimed is:

1. A terminal for waterproof connectors including a receptor portion for receiving a mating terminal, said receptor portion comprising:

a bottom plate;

lateral walls provided upright at opposite sides of said bottom plate; and a slanting insertion guide surface extending from an intermediate height of a front end of each of said lateral walls to a retreated front end of said bottom plate so as to provide a cutaway portion therebelow.

2. A terminal for waterproof connectors according to claim 1, wherein said receptor portion further comprises a folded-back resilient contact plate continuous to said front end of the bottom plate via a curved bent portion which is positioned so as to protrude downwardly of a level of internal ends of said slanting insertion guide surfaces.

3. A terminal for waterproof connectors according to claim 2, wherein an angle between a line tangent to said curved bent portion and a terminal insertion direction line is set 90 degrees or more.

4. A terminal for waterproof connectors according to claim 1, wherein a forwardly-facing curved guide surface is provided between a front end surface of each lateral wall and said slanting insertion guide surface.

5. A terminal for waterproof connectors according to claim 1, which is formed from a one-piece metal blank.

6. A terminal for waterproof connectors including a receptor portion for receiving a mating terminal, said receptor portion comprising:

a bottom plate;

lateral walls extending upright at opposite sides of said bottom plate; and a slanting, inwardly bent insertion guide surface extending from a first intermediate height of a front end of each of said lateral walls to a lower height thereof disposed above a retracted front end said bottom plate so as to provide a cutaway portion therebelow, by means of which front lower edges of said lateral walls are displaced inwardly of a contour of said receptor portion.

* * * * *